United States Patent [19]

Fries et al.

[11] 4,348,282

[45] Sep. 7, 1982

[54] OIL-COLLECTING SHIP

[75] Inventors: Ortwin Fries; Claus Lühring, both of Brake, Fed. Rep. of Germany

[73] Assignee: C. Lühring-Schiffswerft-Trockendock, Brake, Fed. Rep. of Germany

[21] Appl. No.: 218,691

[22] Filed: Dec. 22, 1980

Related U.S. Application Data

[63] Continuation of Ser. No. 947,456, Oct. 2, 1978, abandoned.

[30] Foreign Application Priority Data

Oct. 4, 1977 [DE] Fed. Rep. of Germany ..... 2744517

[51] Int. Cl.[3] ..... B63B 35/28

[52] U.S. Cl. ..... 210/242.3; 210/923; 114/26; 114/29; 114/77 K; 114/73

[58] Field of Search ..... 114/26, 27, 29, 30, 114/61, 73, 77 R, 77 A; 210/242 R, 242 S, 242 AS, DIG. 25–DIG. 27, 242.3, 923; 440/53

[56] References Cited

U.S. PATENT DOCUMENTS

| | | | |
|---|---|---|---|
| 180,622 | 8/1876 | Murphy | 114/30 |
| 1,266,362 | 5/1918 | Wells | 114/77 R |
| 3,176,645 | 4/1965 | Shatto | 115/35 |
| 3,186,369 | 6/1915 | McLennan | 114/77 R |
| 3,320,919 | 5/1967 | Deale | 114/77 R |
| 3,348,690 | 10/1967 | Cornelissen | 210/242 S |
| 3,572,277 | 3/1971 | Sehousboe | 114/77 R |
| 3,708,070 | 1/1973 | Bell | 210/DIG. 25 |
| 4,033,876 | 7/1977 | Cocjin | 210/242 S |
| 4,046,096 | 9/1977 | Liahen | 115/35 |

*Primary Examiner*—Trygve M. Blix
*Assistant Examiner*—D. W. Keen
*Attorney, Agent, or Firm*—Toren, McGeady & Stanger

[57] ABSTRACT

An oil-collecting ship having two floating bodies which can be spread apart and which are hinged together at their rearward ends. Each of the floating bodies is a stable ship's body half. The two halves are provided with oil suction devices for picking up oil which has been pushed together by the floating bodies in a spread-apart condition. At least one locking device keeps the floating bodies in the unspread, closed state parallel to the longitudinal axis of the ship. A main drive is also provided. The bow of each ship's body half is provided with an auxiliary drive unit. Various arrangements of each body half are described.

10 Claims, 3 Drawing Figures

OIL-COLLECTING SHIP

This is a continuation of application Ser. No. 947,456, filed Oct. 2, 1978, now abandoned.

FIELD OF THE INVENTION

The invention relates to an oil-collecting ship, having two floating bodies which can be spread apart and which are hinged together at their rearward ends, having oil suction devices for picking up the oil which has been pushed together by means of the spread-apart floating bodies, having at least one locking device keeping the floating bodies in the unspread, closed state parallel to the longitudinal axis of the ship, and having a main drive arranged at the stern.

BACKGROUND OF THE INVENTION

In the case of oil spills, particularly when oil breaks out in an offshore region, the open sea as well as the shores are threatened with extensive contamination. The removal, of course, is very expensive.

In the fight against oil spills at the present time, oil-collecting ships in the form of catamarans are used; however, they only have a very limited effectiveness and width. Moreover, ships of this type cannot be used for any other purpose and, in addition, they represent unemployed capital during the time they are not used for oil spills in the offshore region.

Further, in the fight against oil spills, so-called skimmers are used which skim the oil by means of rotating drums. Other examples are disclosed in U.S. Pat. Nos. 3,753,496, issued Aug. 21, 1973, and 3,853,767, issued Dec. 10, 1974. Such skimmers operate within oil barriers which have been formed by means of floating bodies which have been joined together in a row. It is said that these oil barriers have numerous disadvantages. First, they do not have a very deep draft so that the oil can pass underneath them when the waves are high; also, they do not project very far beyond the water surface so that there is the danger that oil will be washed over them. In addition, these oil barriers must be towed by additional tugboats.

OBJECTS OF THE INVENTION

An object of the invention is based on the task of creating an oil-collecting ship of the above-mentioned type, which can be used effectively as an oil-collecting or oil-skimming ship for fighting oil contamination in the case of oil spills in the offshore region, particularly in unfavorable weather conditions and for long oil drifts; however, outside of this special use, an object of the invention is to use the ship as a conventional tanker; and a further object is that it should particularly be possible to use the oil-collecting ship in a relatively heavy sea.

SUMMARY OF THE INVENTION

In accordance with the invention, the above objects are achieved by providing that the oil-collecting floating bodies consist of two ship's body halves which are immediately connected to each other at the stern of the ship by means of a hinge and that a locking device holding together the ship's body halves in the closed state is provided at the forecastle end bulkhead; and that at the bow of each ship's body half, an auxiliary drive unit is provided. Another example is disclosed in U.S. Pat. No. 3,734,050, issued May 22, 1973.

In a preferred embodiment, each ship's body half is stable in itself. In this manner, both ship's body halves remain on the water surface, do not tilt and remain movable when the hinge breaks apart. Another embodiment has the advantageous feature that the essential superstructures are arranged on one ship's body half. According to another embodiment it is provided that each ship's body half has a main drive, ventilation plants with exhaust posts, and pump and engine rooms.

An especially preferred embodiment of the invention provides that in the ship's wall of each ship's body half facing toward the other ship's body half there are arranged suction openings, wherein it is particularly provided that the suction openings are constructed as longitudinal slots which can be moved by means of hydraulically operated link slides.

The closing of the two ship's body halves after the mission has been carried out is particularly facilitated by the locking devices each having a tapered guide in one ship's body half and, interacting therewith, a tapered pin in the other ship's body half. An especially preferred embodiment of the invention provides that the auxiliary drives can be rotated about 360° in the form of maneuver propellers.

For a better understanding of the present invention, reference is made to the following description and accompanying drawings while the scope of the invention will be pointed out in the appended claims.

DESCRIPTION OF THE PREFERRED EMBODIMENTS

Figure 1:
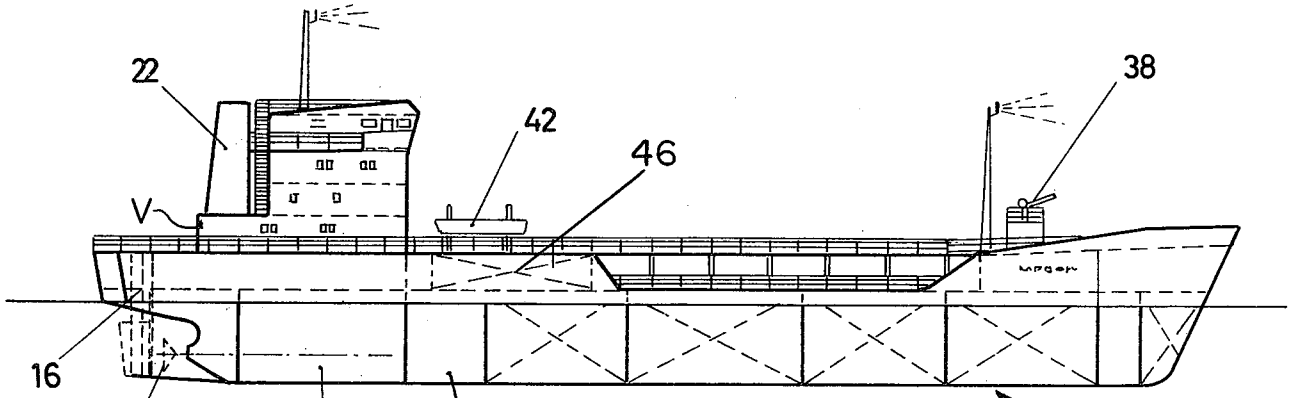
FIG. 1 shows a side view of an oil-collecting ship in accordance with the invention.
Figure 2:
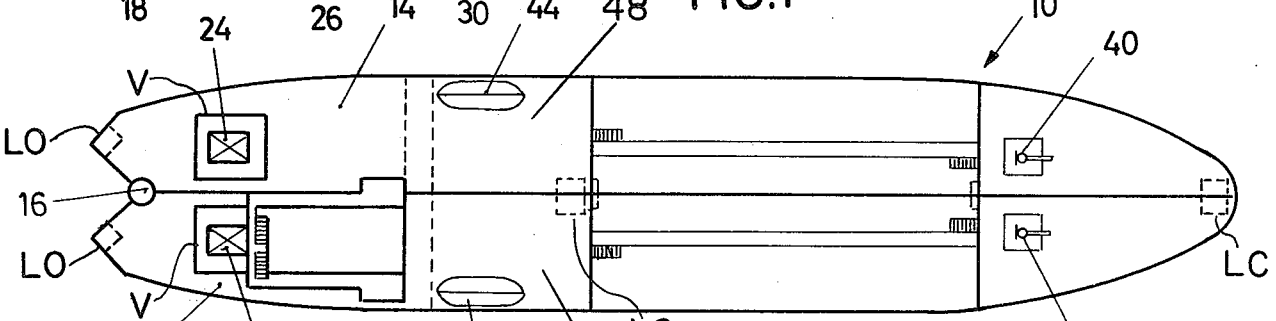
FIG. 2 shows a top view of the oil-collecting ship in accordance with the invention in the closed state.
Figure 3:
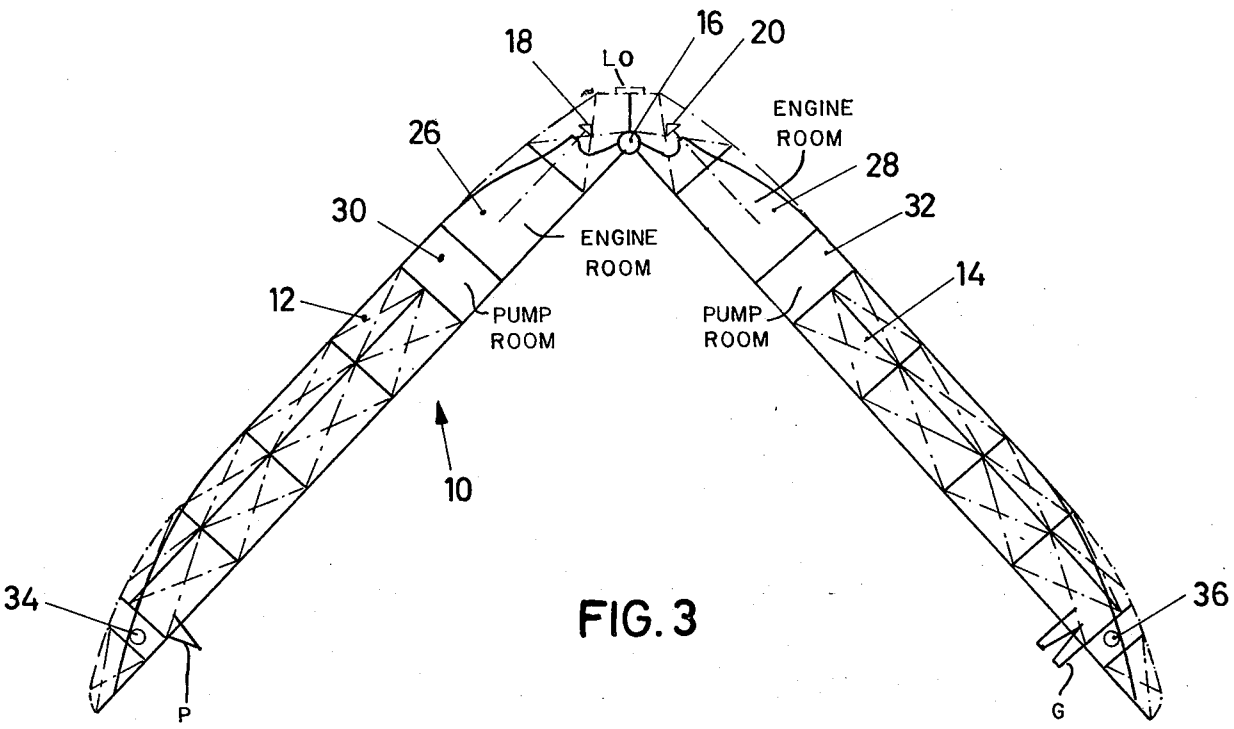
FIG. 3 shows, in a reduced scale, a horizontal section through the inventive oil-collecting ship in the opened state.

According to FIG. 1, the embodiment of the multi-purpose ship 10 in accordance with the invention represents a coastal tanker which, as can be seen from FIG. 2, is very wide relative to its length. In this case, the multi-purpose ship 10 consists of two ship's body halves 12, 14 which are arranged next to each other and which are each stable in itself and are seaworthy. The two ship's body halves 12, 14 are connected to each other by means of a joint which, in the present case, is constructed as a hinge or joint 16. Such a joint may be selected from those used previously to hold ship parts together for hinged movement as disclosed as in, e.g. U.S. Pat. Nos. 3,708,070 issued Jan. 3, 1973, and 4,033,876 issued July 5, 1977, which patents are incorporated by reference herein. In the closed state, the ship's body halves 12, 14 are held together at the poop front bulkhead and the forecastle end bulkhead by means of hydraulically operated locking devices LC. Such locking devices may also be selected from devices used in the past to lock movable ship parts to one another, as disclosed, in, e.g., U.S. Pat. Nos. 1,266,362 issued May 14, 1918, and 3,186,369 issued June 1, 1965, which patents are incorporated by reference herein. These locking devices LC are preferably to be supplemented by pyramidal pins P and guide G in the surfaces of the two body halves which face each other (FIG. 3), so that the ship's body halves 12,14 are exactly guided against each other during closing.

The square stern of each ship's body half is constructed at the inner side of the hinge 16 in such a way that the ship's body halves 12, 14 can be opened about the hinge 16 to an angle of about 90°. At this angle, the inner sides of the square sterns of the two ship's body halves 12,14 abut against each other and can be locked by means of a locking device LO in the opened state of the multi-purpose ship 10 so that, by means of this locking device, a portion of the forces acting on the hinge 16 can be absorbed.

Each ship's body half 12, 14 has its own main drive 18,20 and each having ventilation plants or units V, exhaust posts 22, 24 as well as engine rooms 26,28 and pump rooms 30,32. An example of a suitable engine room ventilation unit is disclosed in U.S. Pat. No. 1,575,447, issued Mar. 2, 1926. Also in each ship's body half 12,14, the inventive multi-purpose ship 10 has in its bow 33 an auxiliary drive 34,36 with an extendable maneuver propeller for driving and positioning the multi-purpose ship, the propeller being rotatable about 360° for this purpose. On the front portion of the ship there are on each ship's body half 12, 14 from guns 38,40 to be able to, if necessary, put up a fire barrier. Each ship's body half 12, 14 has, approximately midships, below the life boats 42,44, an oil separator 46,48 or a slot tank 10. Other examples are disclosed in U.S. Pat. Nos. 3,948,768, issued Apr. 6, 1976, and 3,957,009, issued May 18, 1976.

While the essential operational elements of the multi-purpose ship 10 exist in each ship's body 12, 14, i.e. two-fold (such as, for example, twin propeller drive, etc.), the superstructures 50, particularly the superstructure decks, are arranged only on one ship's body half, namely on the right ship's body half 12 in the shown embodiment. The necessary steering chains and rods, etc. are passed through the hinge 16 which has a wide diameter so that a passage may lead through the hinge 16 through which it is possible to walk and which can be locked by means of doors.

The multi-purpose ship in accordance with the invention is normally used as a coastal tanker. The maneuver propellers may then serve as bow rudders. When the multi-purpose ship 10 is to be used for an oil-collecting mission, it proceeds in the closed state immediately to the point where the oil spill occurred. There the locking devices at the poop front bulkhead and the forecastle end bulkhead are opened and the ship's body halves 12, 14 are moved apart by means of the auxiliary drives 34, 36 arranged in the fore bodies as maneuver propellers. After an opening angle of about 90° has been obtained, the inner sides of the square stern being joined together at this angle, the lock at the square stern is locked so that a portion of the forces acting on the hinge 16 are absorbed by the locking device at the square stern. The maneuver propellers are now rotated in such a way that they can serve for a slow movement into the oil field or for positioning the multi-purpose ship 10 in the opened state.

In the opened state, the illustrated multi-purpose ship has a catchment width of about 100 m. This is sufficient to pick up oil drifts which have been driven apart by the wind. According to experience, these drifts are very long, but have only a limited width. Between the legs of the open triangle formed by the ship's halves 12, 14, the oil can be skimmed by means of one or several commercially available devices, for example skimmers, and can be delivered to the oil separators 46,48 arranged in the two ship's halves. However, it can also preferably be provided that suction openings are arranged at the inner ship's wall of each ship's body half 12, 14. These suction openings are particularly constructed as movable longitudinal slots which can be moved vertically by means of hydraulically operated link slides in dependence on the draft of the multi-purpose ship 10. In this manner, the oil can be sucked off directly through the slots.

The oil separators 46,48 can be dimensioned within a wide range of sizes. In the oil separators, the sucked up water is separated from the oil and is again discharged to the outside, while the skimmed-off oil is bunkered in the sufficiently large cargo tank room and can, if necessary, be transferred to the other ships by means of transfer devices. More particularly, the multi-purpose ship 10 can also be moved very closely toward an oil source and, if necessary, can there be coupled with other multi-purpose ships of the same type so that the entire oil source is closed off tightly. Furthermore, in another extremely useful application, the multi-purpose ship 10 can simultaneously also be used as a ship for extinguishing fires.

While the foregoing description and drawings represent the preferred embodiments of the present invention, it will be obvious to those skilled in the art that various changes and modifications may be made therein without departing from the true spirit and scope of the present invention.

What is claimed is:

1. An oil-collecting ship comprising:

an elongated ship body including two bouyant seaworthy body halves arranged to be separable from one another generally along the vertical longitudinal plane of symmetry of said ship body;

a movable joint arranged at the stern of said ship body for directly connecting the rearward ends of said body halves so that said body halves can be separated to a stable spread apart condition relative to one another to collect oil on the water surface;

means for skimming the oil from the water surface after the oil has been contained by said body halves when in said spread apart condition;

a first locking device arranged at the forecastle end bulkhead of said ship body for holding said two body halves together in abutting relationship in a closed condition;

at least one main drive arranged at the stern of said ship body for propelling the ship when said two body halves are in said closed condition; and two auxiliary drive units each arranged at the bow of a different one of said two body halves for separating said two body halves and for propelling the ship when said two body halves are in said spread apart condition.

2. An oil-collecting ship according to claim 1, wherein only one of said body halves has superstructures of the ship arranged thereon.

3. An oil-collecting ship according to claim 1, comprising two main drive units each arranged on a different one of said two body halves, each of said body halves including a ventilation unit and an exhaust gas post for said ventilation unit, a pump room and an engine room.

4. An oil-collecting ship according to claim 1, including at least one oil separator for separating the oil from the water obtained from said skimming means, and an associated tank for storing the separated oil.

5. An oil-collecting ship according to claim 1, wherein said two auxiliary drive units each include a maneuver propeller arranged to be rotatable over 360°.

6. An oil-collecting ship according to claim 1, wherein said movable joint comprises a hinge.

7. An oil-collecting ship according to claim 1, wherein said movable joint comprises a spherical joint.

8. An oil-collecting ship according to claim 1, wherein said two body halves form an angle of about 90° in said spread apart condition, and including a second locking device at the stern of said ship body for locking said body halves in said spread apart condition.

9. An oil-collecting ship according to claim 1, including a second locking device arranged at the poop front bulkhead of said ship body for holding said two body halves together in abutting relationship in said closed condition.

10. An oil-collecting ship according to claim 1, wherein side surfaces of said body halves facing toward each other have at least one tapered guide associated with one of said body halves and a correspondingly tapered pin associated with the other one of said body halves for guiding said body halves against each other to said closed condition.

* * * * *